US009850653B1

(12) United States Patent
Gerard

(10) Patent No.: US 9,850,653 B1
(45) Date of Patent: Dec. 26, 2017

(54) MODULAR ELEVATOR SHAFT ASSEMBLY AND METHOD FOR MAKING THE SAME

(71) Applicant: PaR Systems, Inc., Shoreview, MN (US)

(72) Inventor: Michael Gerard, Iron Mountain, MI (US)

(73) Assignee: PAR SYSTEMS, INC., Shoreview, MN (US)

( * ) Notice: Subject to any disclaimer, the term of this patent is extended or adjusted under 35 U.S.C. 154(b) by 0 days.

(21) Appl. No.: 15/203,509

(22) Filed: Jul. 6, 2016

(51) Int. Cl.
*E04B 1/00* (2006.01)
*E04B 1/34* (2006.01)
*E04F 17/00* (2006.01)

(52) U.S. Cl.
CPC ..... *E04B 1/34* (2013.01); *E04F 17/005* (2013.01)

(58) Field of Classification Search
CPC .... E04F 17/005; E04B 2001/246; E04B 1/34; E04B 2001/3241; E04H 12/00
See application file for complete search history.

(56) References Cited

U.S. PATENT DOCUMENTS 3,650,078 A * 3/1972 Jennings ..... E04G 1/14 182/178.6
3,741,351 A 6/1973 Suozzo
3,747,689 A * 7/1973 Frederick ..... E02D 13/04 173/90
3,845,842 A * 11/1974 Johnson ..... B66B 17/12 187/266
3,991,528 A 11/1976 Dillion
4,231,148 A 11/1980 Harding
4,262,773 A * 4/1981 Basham ..... E04G 1/20 182/132
4,907,675 A * 3/1990 Saby ..... E04G 1/14 182/104
4,986,040 A 1/1991 Prewer et al.
5,012,621 A 5/1991 Power et al.
5,529,428 A * 6/1996 Bischof ..... F16B 12/14 403/408.1
5,878,846 A 3/1999 O'Donnell
5,980,160 A * 11/1999 Vanderklaauw ..... B66F 1/00 182/178.1
6,047,509 A * 4/2000 Savoie ..... E04B 2/7425 403/231
6,167,670 B1 1/2001 Reite et al.
6,389,773 B1 * 5/2002 Reuter ..... E04B 2/7425 160/135

(Continued)

OTHER PUBLICATIONS

Office Action from U.S. Appl. No. 13/832,798, dated May 29, 2015.

(Continued)

*Primary Examiner* — Beth Stephan
(74) *Attorney, Agent, or Firm* — Steven M. Koehler; Westman, Champlin & Koehler, P.A.

(57) ABSTRACT

An elevator shaft assembly and a method for forming the same includes a plurality of modules, each of the modules having a plurality of walls with an upper perimeter edge and a lower perimeter edge and spaced apart elevator rails. Adjacent modules are aligned with each other along mating upper and lower perimeter portions with complementary aligning members that are joined together with a fastener, the modules when joined together forming a tubular structure.

17 Claims, 15 Drawing Sheets

(56) References Cited

U.S. PATENT DOCUMENTS

| | | | | |
|---|---|---|---|---|
| 6,425,463 | B1 | 7/2002 | Broyan | |
| 6,540,048 | B1 | 4/2003 | Mueller | |
| 6,625,937 | B1 * | 9/2003 | Parker | E04B 1/3483 52/79.1 |
| 6,669,401 | B1 * | 12/2003 | Lin | A47C 11/00 297/440.1 |
| 6,789,977 | B2 * | 9/2004 | Layfield | F16B 5/0012 403/292 |
| 7,871,231 | B2 | 1/2011 | Oshima | |
| 8,800,725 | B2 | 8/2014 | Alois | |
| 2011/0083379 | A1 | 4/2011 | Lavi | |
| 2011/0266413 | A1 | 11/2011 | Fritz | |
| 2011/0297488 | A1 | 12/2011 | Miller et al. | |
| 2012/0168263 | A1 | 7/2012 | Alois | |
| 2012/0240482 | A1 * | 9/2012 | Pitt | E04B 1/3483 52/122.1 |

OTHER PUBLICATIONS

Office Action from U.S. Appl. No. 13/832,798, dated Nov. 10, 2014.
Office Action from U.S. Appl. No. 13/832,798, dated Mar. 27, 2014.

* cited by examiner

MODULAR ELEVATOR SHAFT ASSEMBLY AND METHOD FOR MAKING THE SAME

BACKGROUND

The discussion below is merely provided for general background information and is not intended to be used as an aid in determining the scope of the claimed subject matter.

Aspects of the invention relate to an elevator shaft and forming the same.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background.

An elevator shaft assembly and a method for forming the same includes a plurality of modules, each of the modules having a plurality of walls with an upper perimeter edge and a lower perimeter edge and spaced apart elevator rails. Adjacent modules are aligned with each other along mating upper and lower perimeter portions with complementary aligning members that are joined together with a fastener, the modules when joined together forming a tubular structure

DETAILED DESCRIPTION OF THE ILLUSTRATIVE EMBODIMENT

Figure 1:
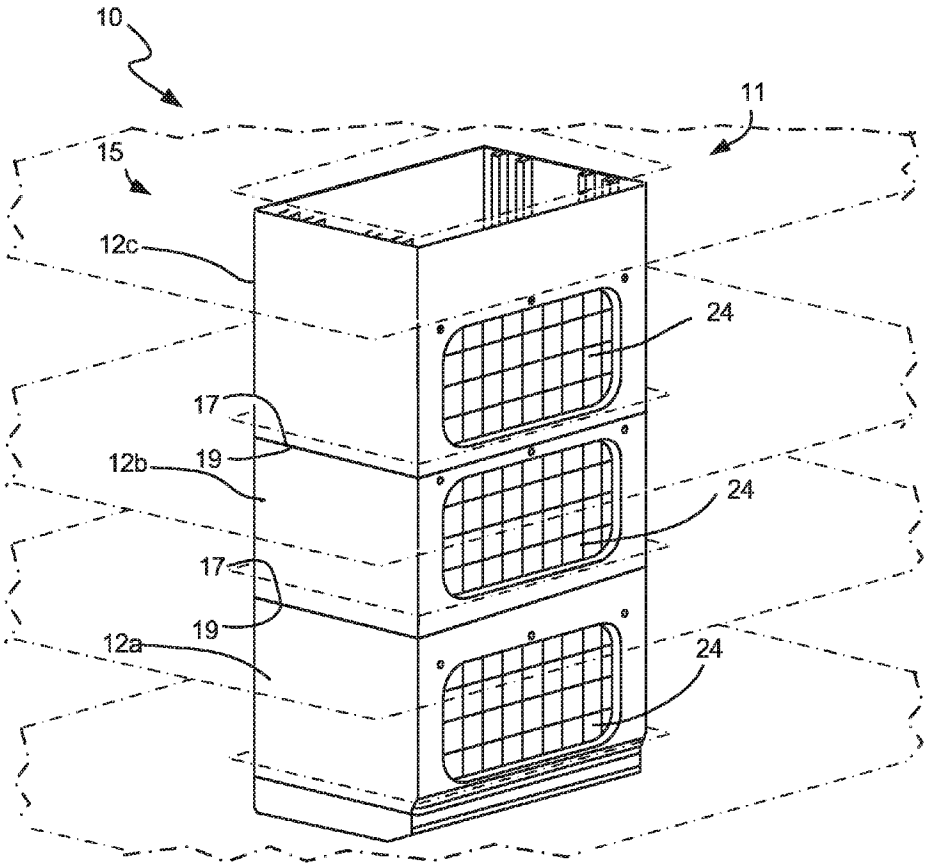
FIG. 1 is a schematic perspective view of a modular elevator shaft assembly.

FIG. 1 illustrates a completed elevator shaft assembly 10 in an installation location 11. Generally, the assembly 10 includes a plurality of shaft modules 12*a*, 12*b*, and 12*c*, stacked upon each other wherein adjacent modules 12*a*-12*c* are fixedly secured to each other using as least some of steps herein described to form at least a tubular structure 15.

Figure 2:
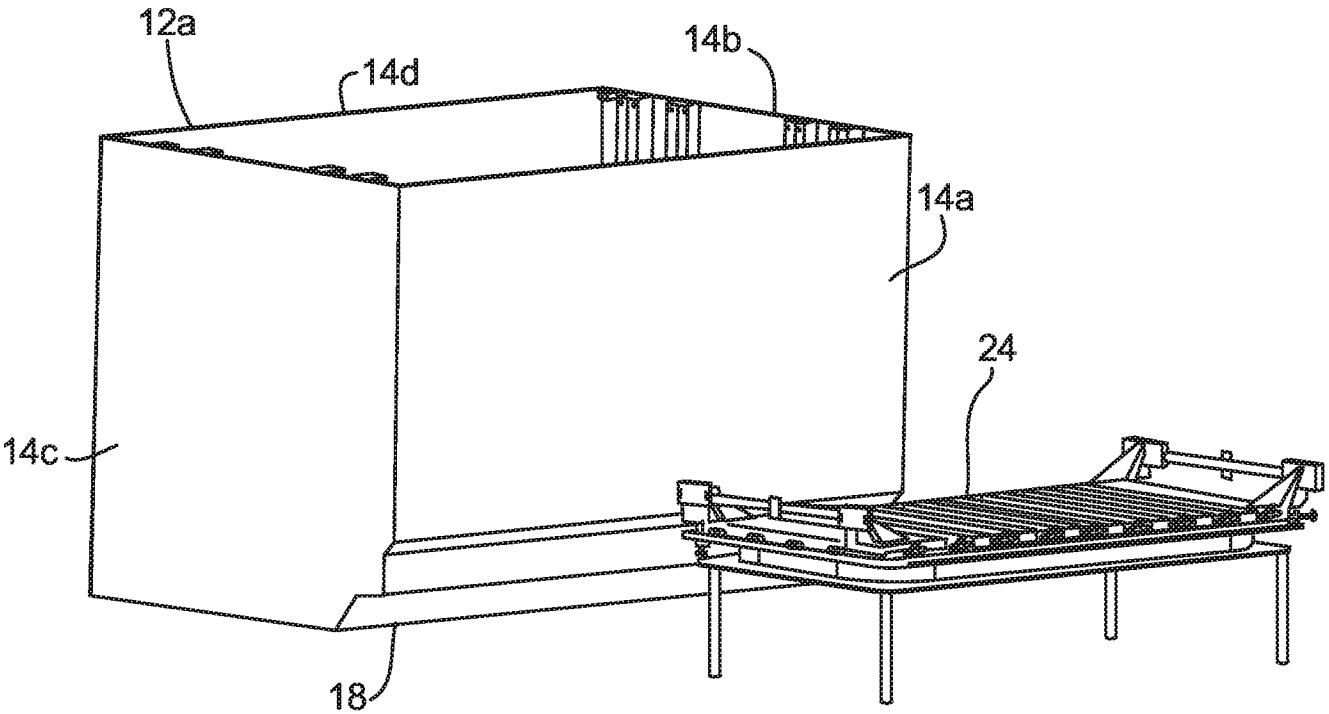
FIGS. 2-7 illustrate steps for constructing an elevator shaft module.
Figure 8:
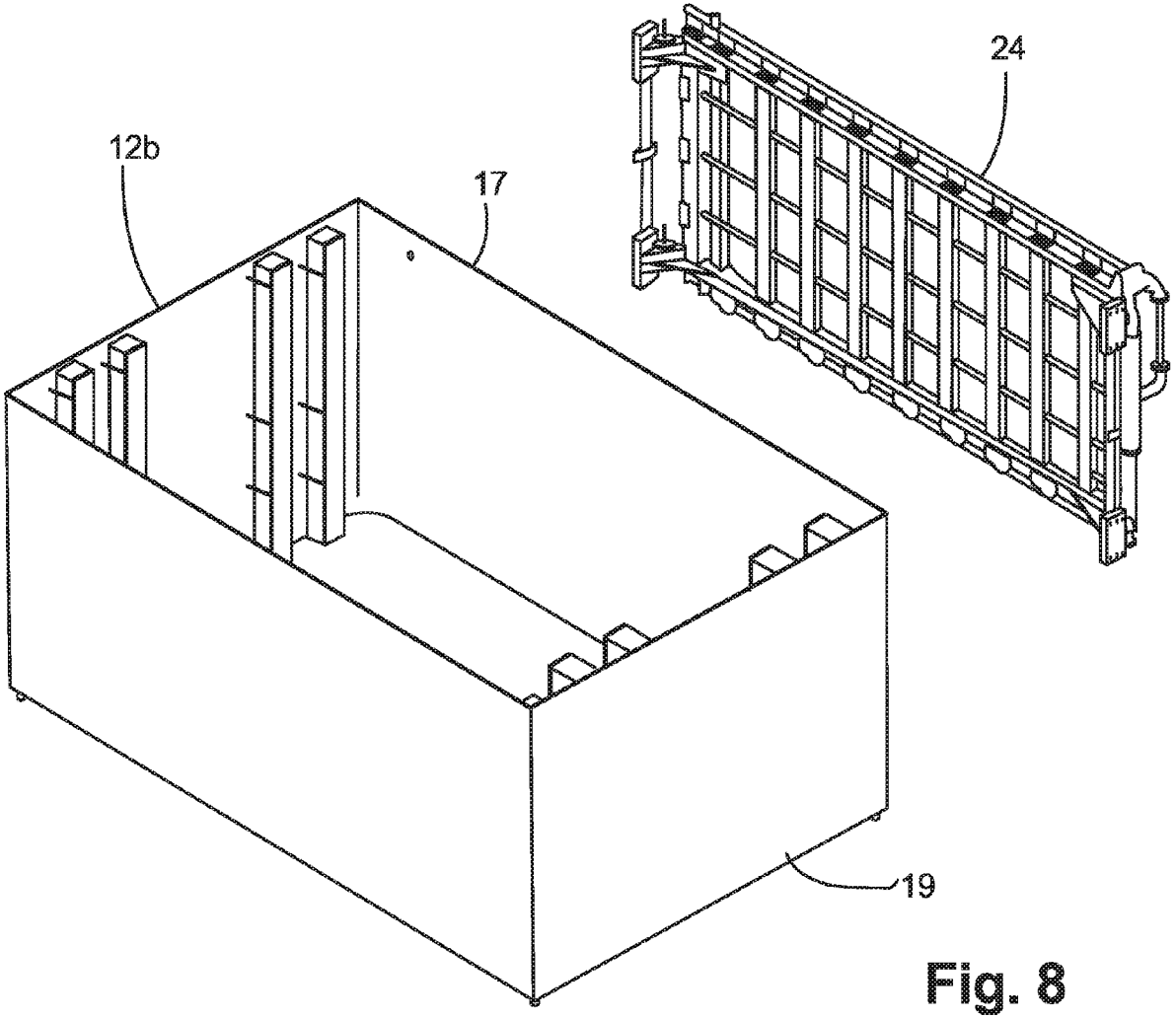
FIG. 8 is a perspective view of an intermediate elevator shaft module.

In the illustrative embodiment, the tubular structure 15, and the shaft modules 12*a*-12*c* have a rectangular cross section formed by four wall sections 14*a*, 14*b*, 14*c*, and 14*d* (FIG. 2) with at least an upper perimeter edge 17 and/or a lower perimeter edge 19 (see also FIG. 8). Adjacent modules are connected together with a fastening device (e.g. welds, fasteners, etc.)

However, it should be understood that the modules 12*a*-12*c* need not be limited to three modules each having four wall sections 14*a*-14*d* as illustrated herein, but rather, can comprise any number of modules having three or more wall sections of selected size and fixedly secured to each other in orientations as desired to form the desired tubular structure 15 for each particular application. Likewise, although illustrated as being planar, one or more wall sections 14*a*, 14*b*, 14*c*, and 14*d* can be non-planar, if desired.

Additional supports to secure the assembly 10 in the installation location 11 can be affixed to the wall sections 14*a*-14*d* as needed. Such supports are not illustrated since their size and orientation are specific to each application. The elevator shaft assembly 10 is particularly useful in multi-floor constructions where operating space is limited during construction and floors of the installation 11 have been constructed such as but not limited to vessels and the like.

FIGS. 2-11 illustrate a method for constructing the elevator shaft assembly 10. However, it should be noted that at least some of the order of steps herein described can be changed for both the construction of individual modules (construction of module 12*a* is discussed below) as well as for the elevator shaft assembly 10.

Figure 5:
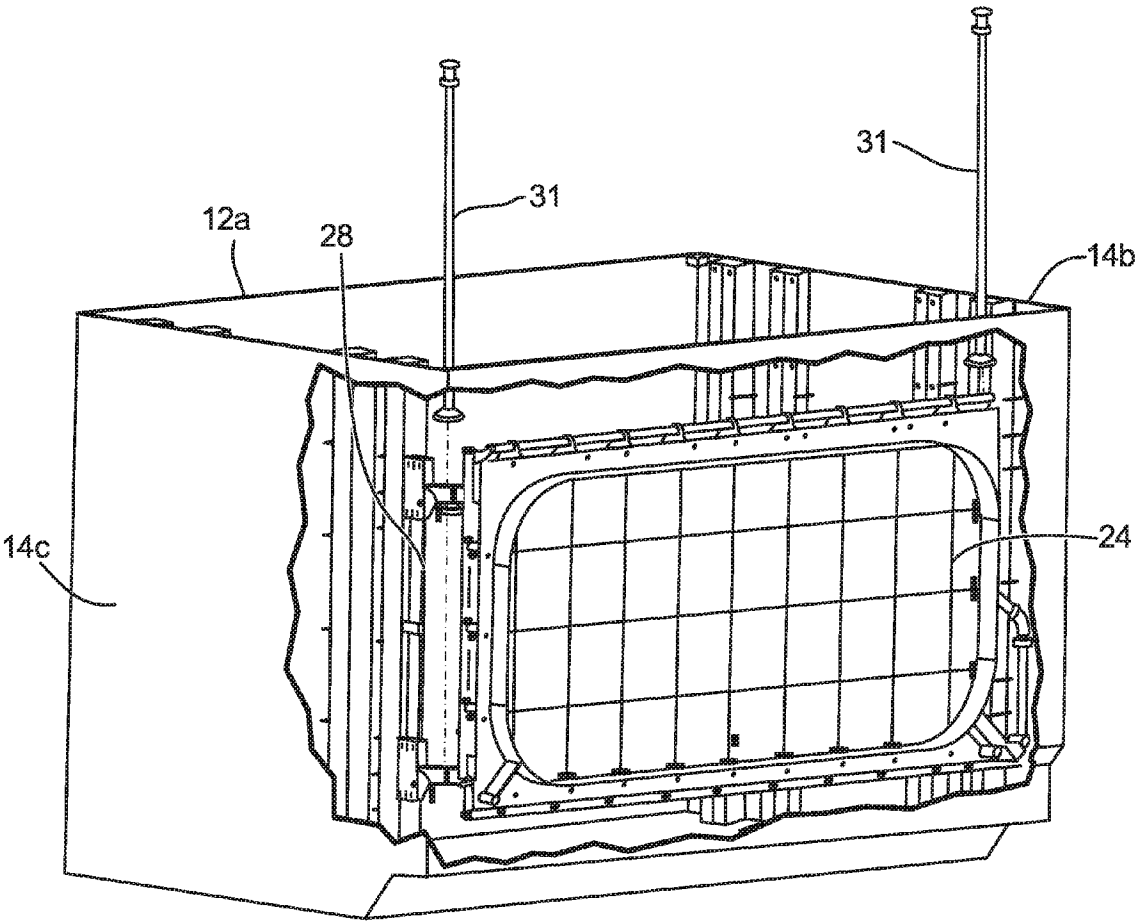
Figure 6:
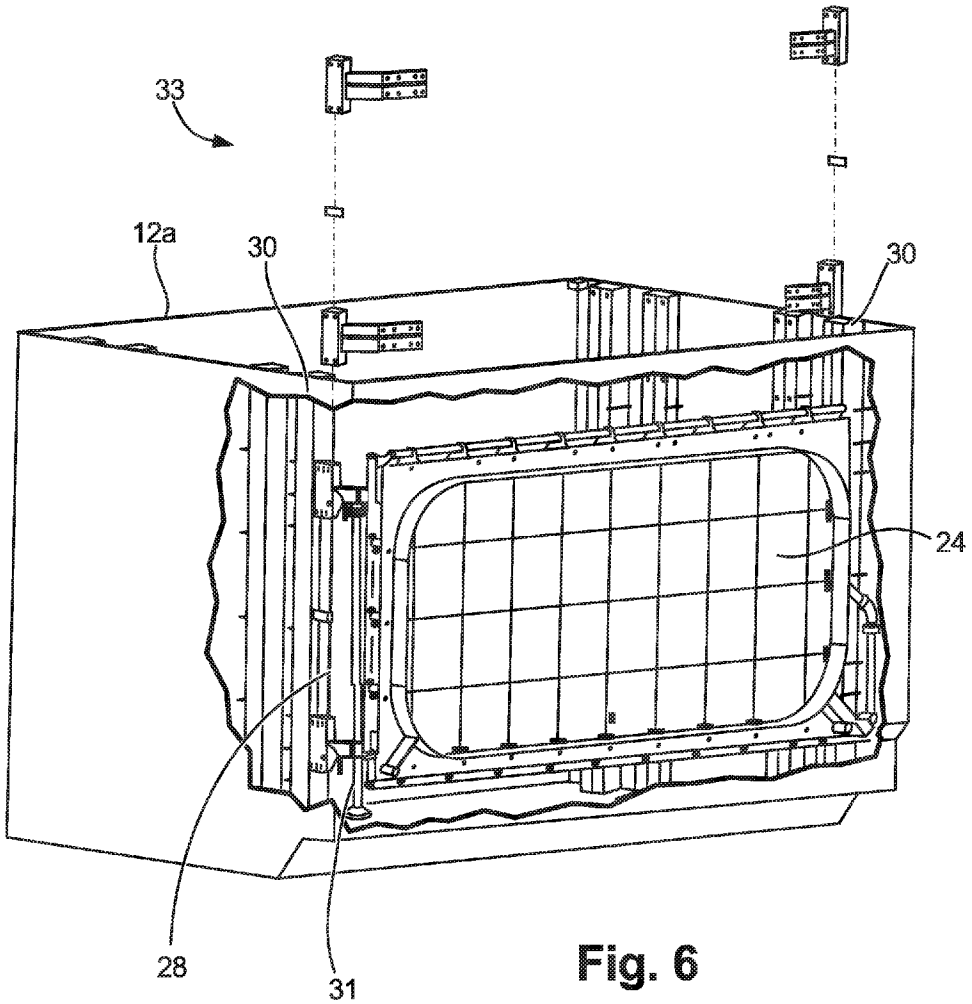
Figure 7:
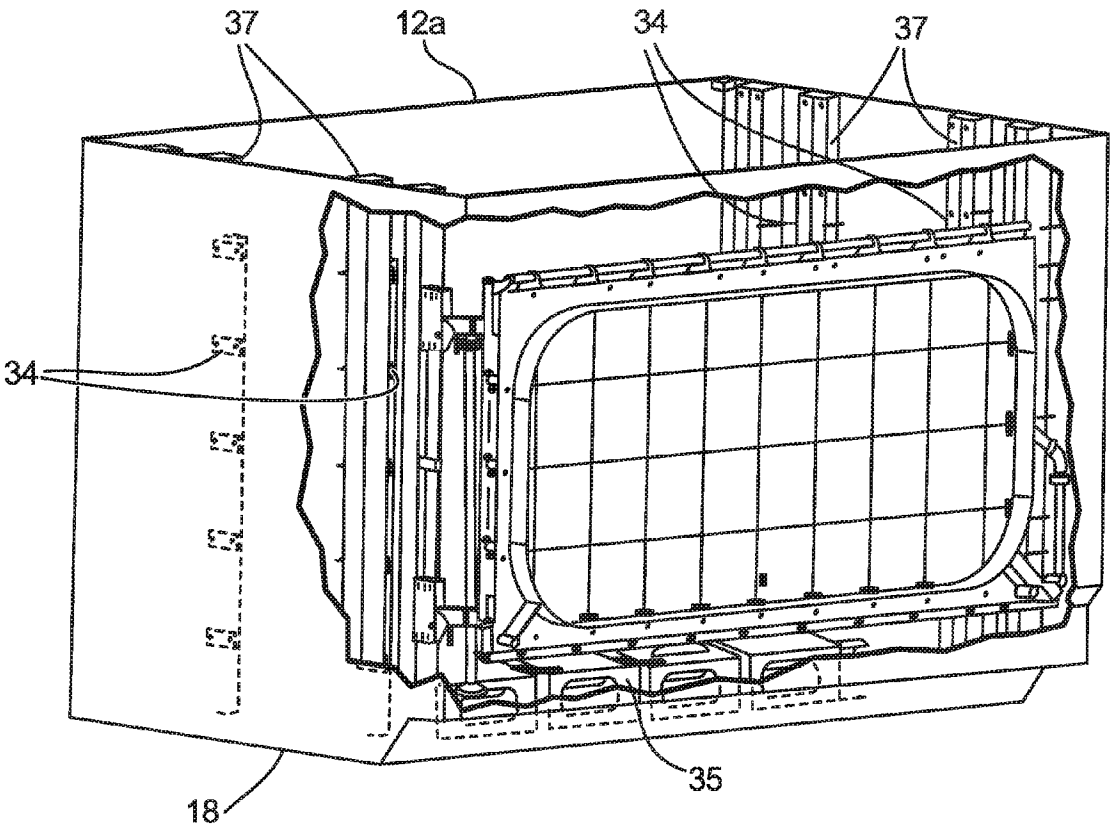

The first elevator shaft module 12*a* is illustrated in FIGS. 2-7. In this embodiment, the module 12*a* includes an optional floor 18 secured to the walls 14*a*-14*d* so as to form a container. As described below, a door assembly 24 can be secured where needed in the module 12*a* or the module 12*a* can be provided with the door assembly 24 in place as illustrated in FIG. 7. As appreciated by those skilled in the art other parts of the modules can be provided as assembled, if desired.

Figure 3:
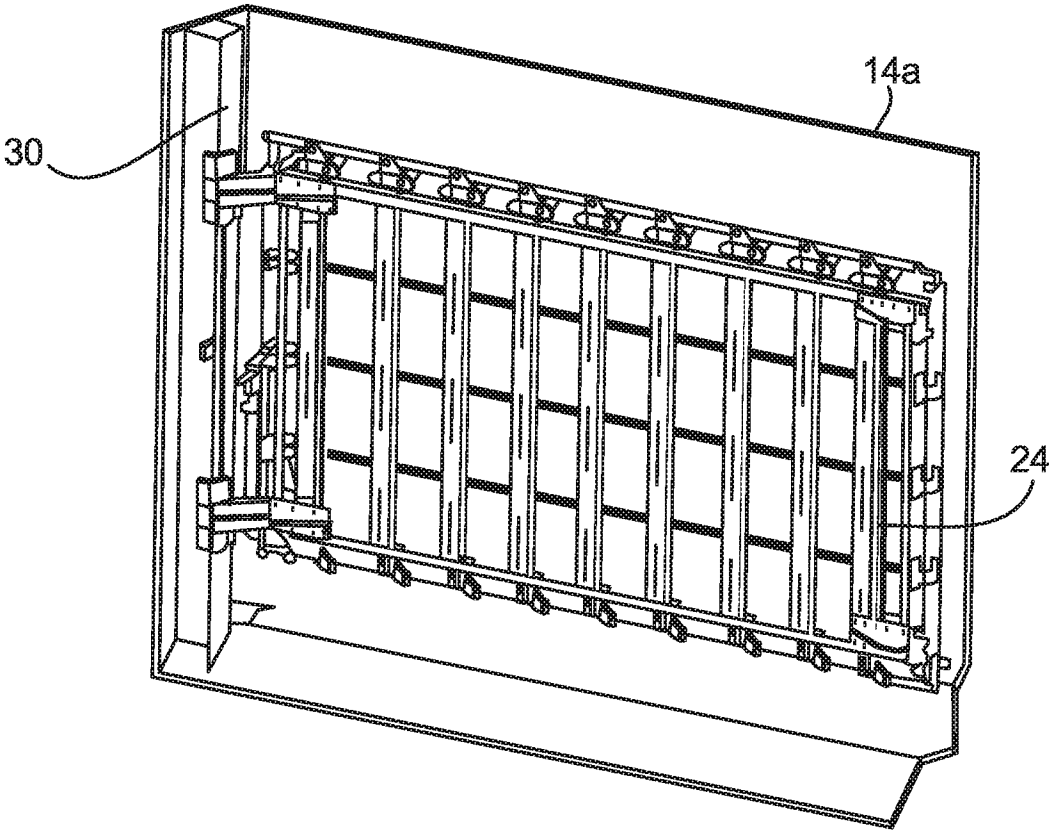

If the module 12*a* does not have the door assembly 24 mounted thereon, the door assembly can be mounted using at least some of the steps illustrated in FIGS. 3-6. Referring to FIG. 3, the door assembly 24 is placed and supported adjacent typically on one of the walls 14*a*-14*d*, herein wall 14*a* upon which the wall 14*a* can be scribed so as to define a door aperture 26. It should be noted that although illustrated wherein a door assembly 24 is being provided in wall 14*a*, this should not be considered limiting in that additional door assemblies 24 can also be mounted on any of the other walls 14*b*-14*d* of the module 12*a*, as well as more than one door assembly 24 on any wall, depending on the desired application and the size, dimensions of the module 12*a*.

Figure 4:
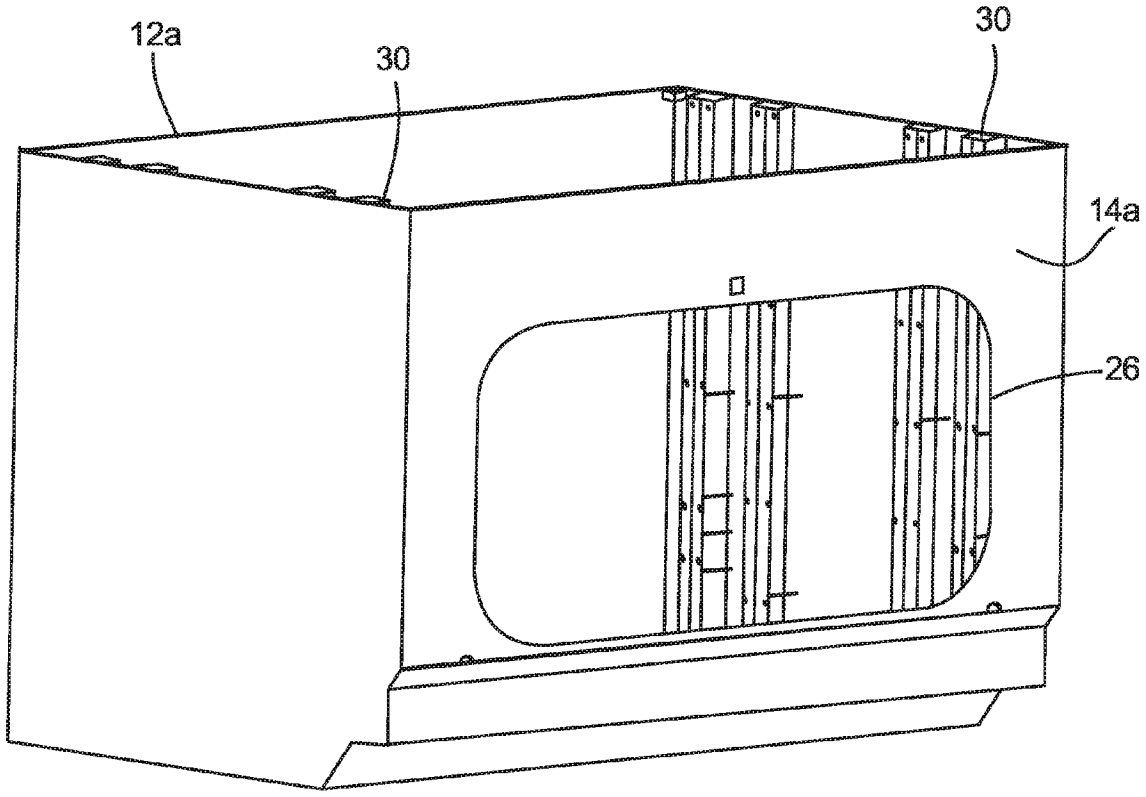

In the embodiment illustrated, the door assembly 24 is held against an inner or inside surface of the wall 14*a*. After scribing the wall 14*a*, the wall 14*a* is cut so as to create the door aperture 26 as illustrated in FIG. 4.

Referring to FIG. 5, the door assembly 26 is then returned to the module 12*a* and mounted to one or more of the wall(s) 14*a*-14*d* as needed for the door assembly 24 being used. This may entail first aligning the door assembly 24 with the door aperture 26 and tack welding or otherwise partially securing the door assembly 24 in place. Door tracks 28 (one of which is illustrated) can then be secured to the wall(s), herein to walls 14*b* and 14*c*. Door cylinder(s) 31 can then be secured in place if not otherwise already provided on the door assembly 24.

FIGS. 3 and 6 illustrate optional support members 30 provided on the module 12*a*, which can be used during installation to support and/or guide the door assembly 24 to the desired position with respect to the door aperture 26. The support members 30 can be configured so as to engage part(s) of the door assembly 24, or as illustrated herein fixture members 33 temporarily secured to the door assembly 24, which are then removed upon securing the door assembly 24 fixedly to the module 12*a*.

Module 12*a* in this exemplary embodiment comprises the lowermost module of the assembly 10. If the module 12*a* includes the optional floor 18 or other floor structure, overtravel buffer module 35, herein having, for example, springs (not shown) can then be mounted to the floor 18 or floor structure or otherwise to the module 12*a* as illustrated in FIG. 7. FIG. 7 also illustrates installation of the elevator rails 34 to inside surfaces of the module 12*a*, if not already provided. In the embodiment illustrated, two of the elevator rails 34 are mounted to support members 37 mounted on inside surfaces of the module 12*a*.

FIG. 8 illustrates an intermediate module 12*b* where like elements have been identified with the same reference numbers. Module 12*b* can be constructed with a door assembly 24 in a manner similar to module 12*a* described above.

Figure 9:
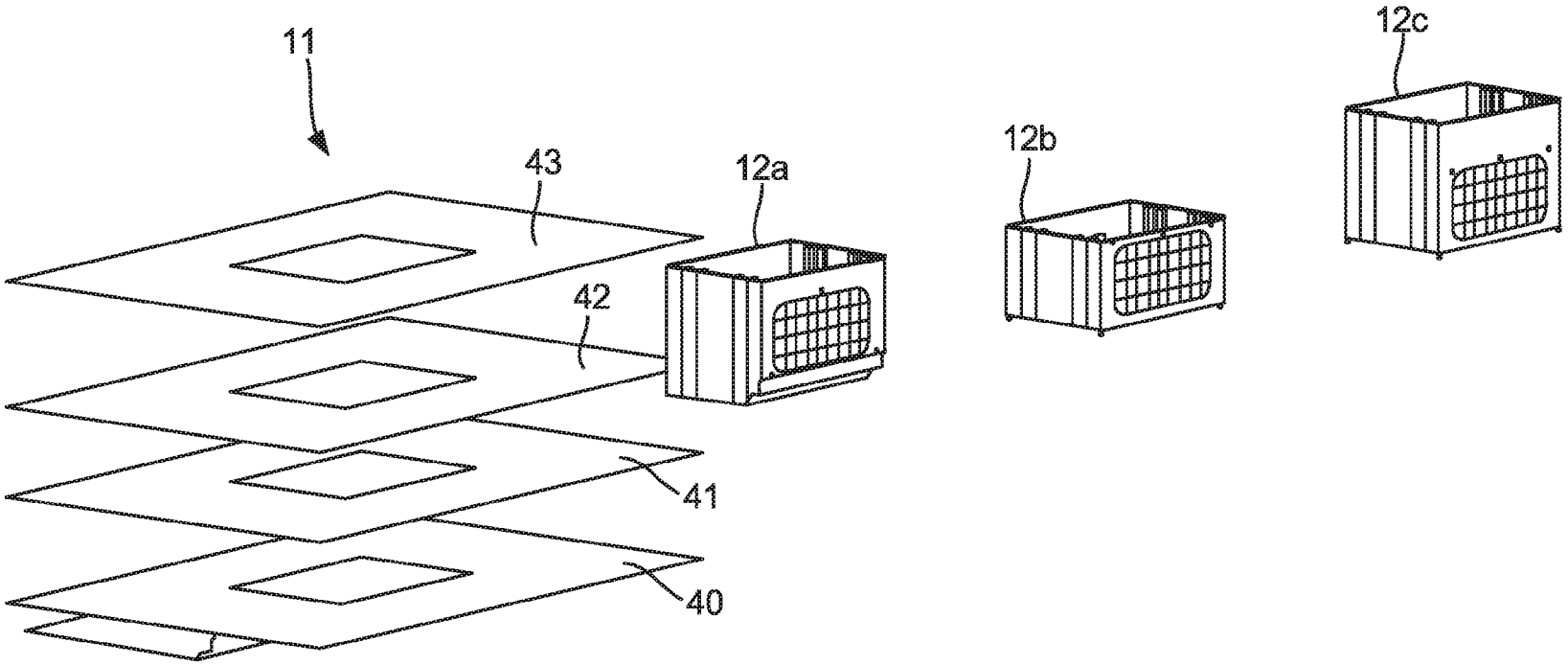
FIG. 9 is a schematic perspective view of a plurality of elevator shaft modules and an installation location.

FIG. 9 illustrates completed modules 12*a*, 12*b* and 12*c* (also an intermediate module constructed in a manner similar to modules 12*a* or 12*b*) and the installation location 11 having floors 40, 41, 42 and 43.

Figure 10:
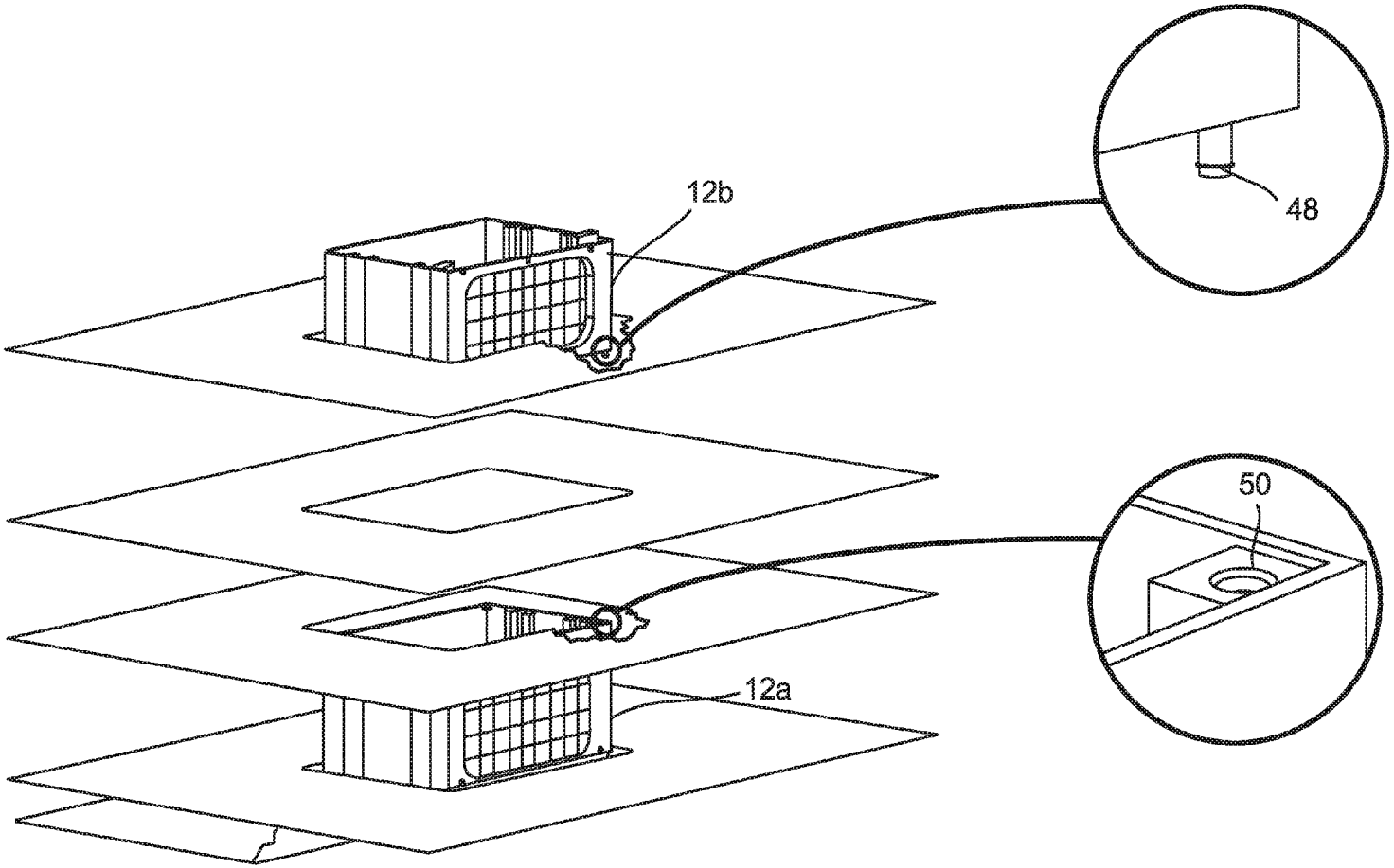
FIG. 10 is a schematic perspective view of aligning members.

In FIG. 10, module 12*a* has been lowered through apertures provided in the floors 41-43 and supported by floor 40. Likewise, module 12*b* is also lowered through apertures in floors 41-43 to be set upon module 12*a*. In the embodiment illustrated, opposed portions of each of the adjacent modules include aligning members 48, 50 to orient the position of the modules relative to each other. A plurality of aligning members can be provided on each of the modules to be connected so as to ensure proper alignment. In one example, the aligning members 48, 50 can comprise complementary projections 48 and recesses or receivers 50, herein apertures, although such aligning members 48, 50 (as well as the location thereof) can take numerous forms and the exemplary embodiment illustrated should not be considered limiting.

Figure 11:
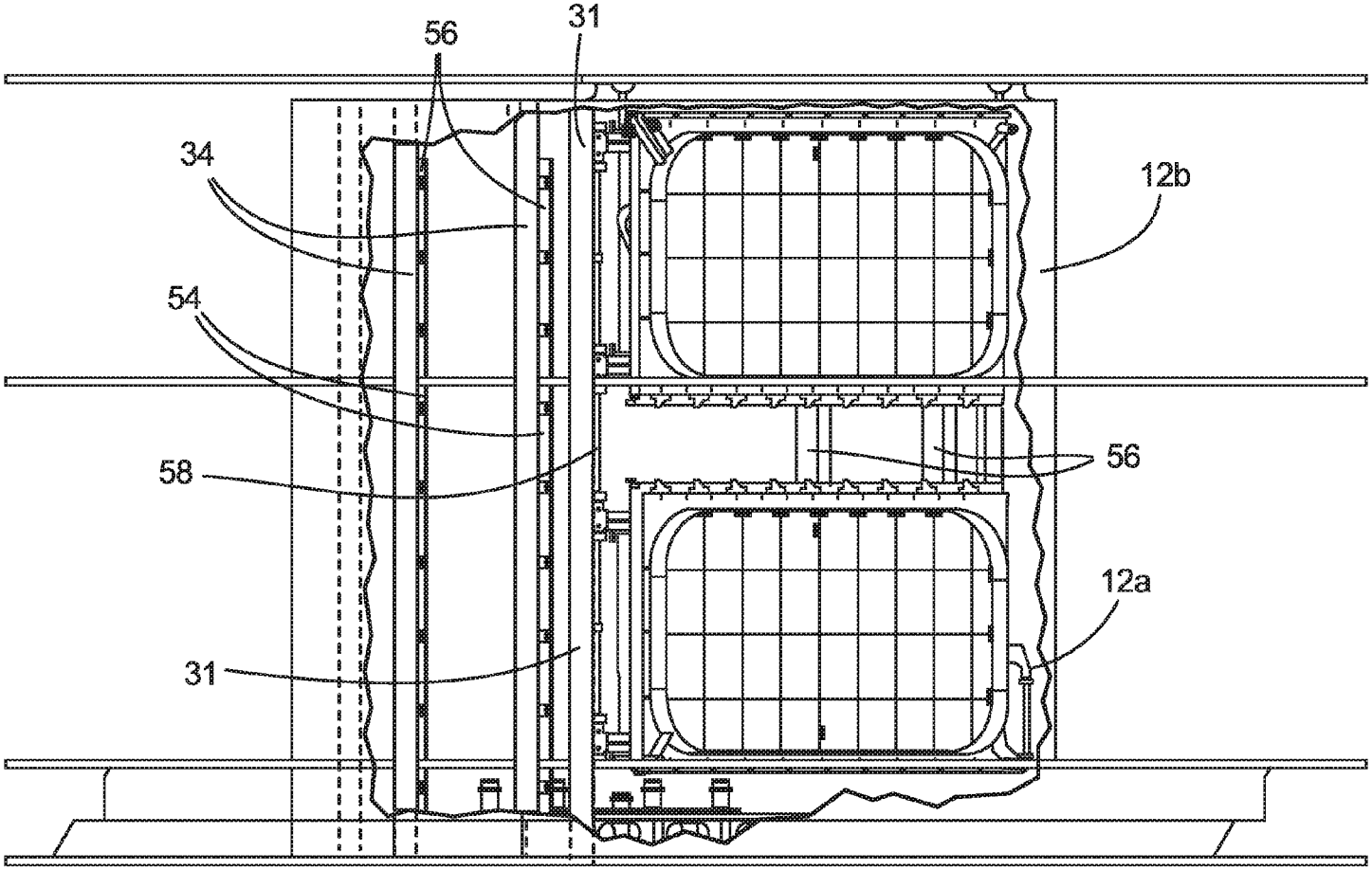
FIG. 11 is a schematic perspective transparent view of connected elevator modules installed.

FIG. 11 illustrates module 12*b* mounted upon module 12*a*. Since each of the modules include elevator rails 34, after proper alignment thereof bridging rails 54 are mounted so as to provide continuous rails 56 between the modules 12*a* and 12*b*. Likewise, if needed, bridging door rails or connectors 58 can be provided to connect the door cylinders 31 of the modules 12*a* and 12*b*. The modules 12*a* and 12*b* can be fixedly secured after installation of the components, although securement of the modules 12*a* and 12*b* prior to installation may be preferred.

Referring back to FIG. 1, module 12*c* can be similarly connected to module 12*b* in a manner similar to that described above. At least bridging rails 54 (not shown in FIG. 1) are provided so as to extend the continuous rails 56 from the module 12*a* to module 12*c*.

It should be noted that although each of the modules 12*a*-12*c* herein illustrated include a door assembly 24, this should not be considered limiting. In particular, adjacent modules in some embodiments may not have any door assemblies, or just one of the modules has a door assembly.

Figure 12:
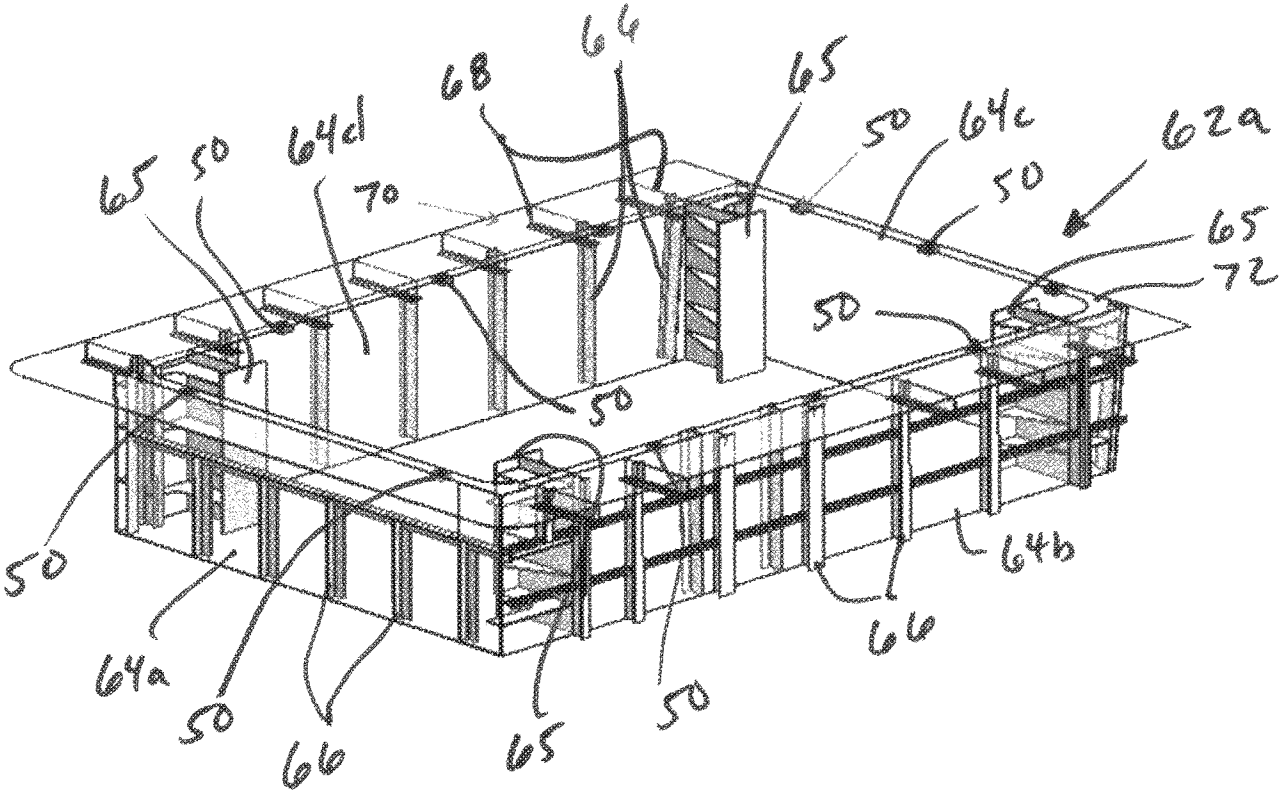
FIG. 12-14 illustrate steps for constructing a second elevator shaft module.
Figure 13:
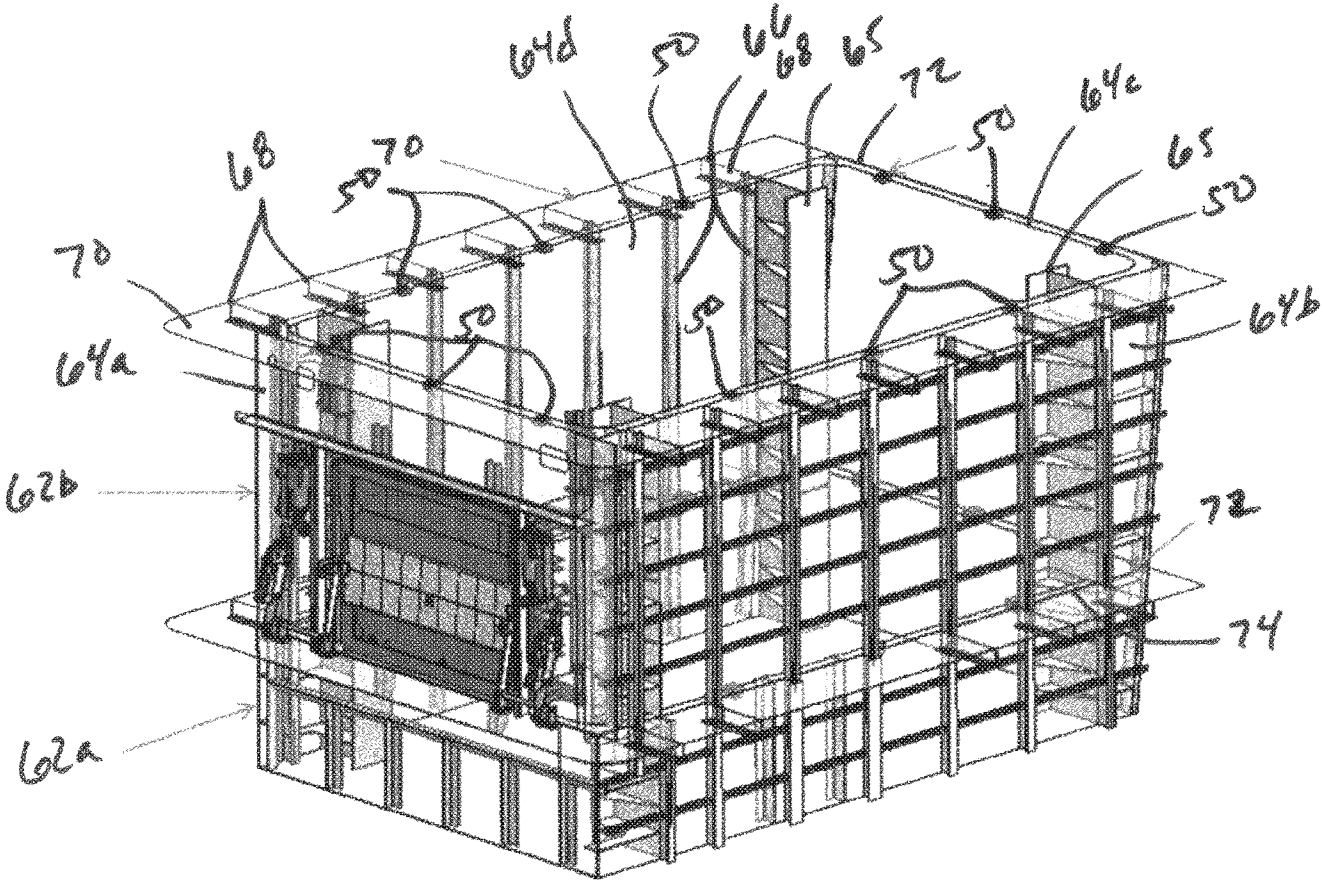
Figure 14:
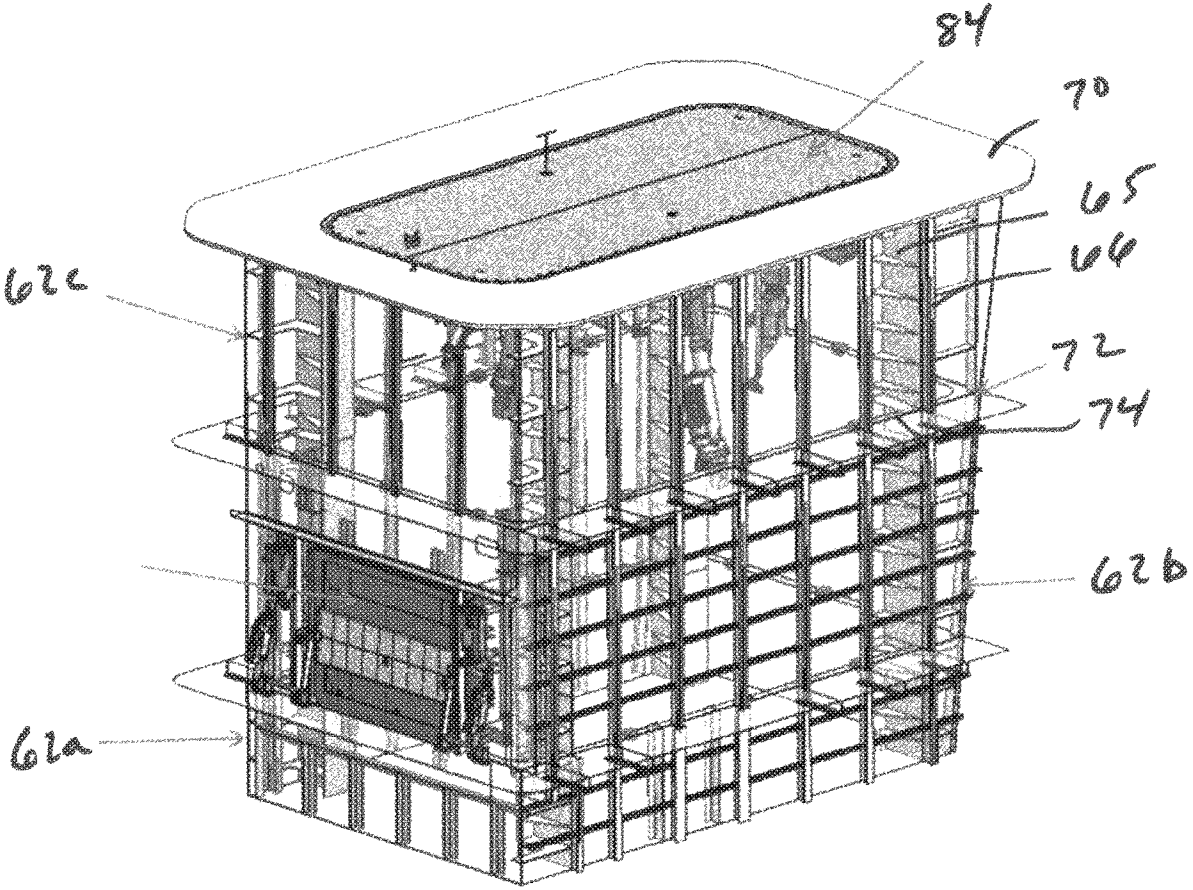

FIGS. 12-14 illustrate construction of a second elevator shaft from modules 62*a*, 62*b* and 62*c*. FIG. 12 illustrates the lowermost or pit module 62*a* that is first lowered into the ship where the elevator shaft is to be constructed, for example, lowered through apertures provided in each of the floors of the ship. The pit module 62*a* is formed of wall sections 64*a*-64*d* having vertical supports 66 and inner rails 65. In one embodiment, the module 62*a* includes a deck skirt 70 on one or more of the wall sections 64*a*-64*d* with horizontal supports 68 supporting the deck skirt 70 and connected to the vertical supports 66, if needed.

FIG. 13 illustrates module 62*b* stacked upon module 62*a*. Like module 62*a*, module 62*b* is formed of wall sections 64*a*-64*d* having vertical supports 66 and inner rails 65 that are aligned with rails 65 of module 62*a*. Module 62*b* can also include a deck skirt 70 on one or more of the wall sections 64*a*-64*d* with horizontal supports 68 supporting the deck skirt 70 and connected to the vertical supports 66, if needed. Module 62*b* includes a door assembly 69, which can be mounted to a wall section in a manner as described above.

Figure 15:
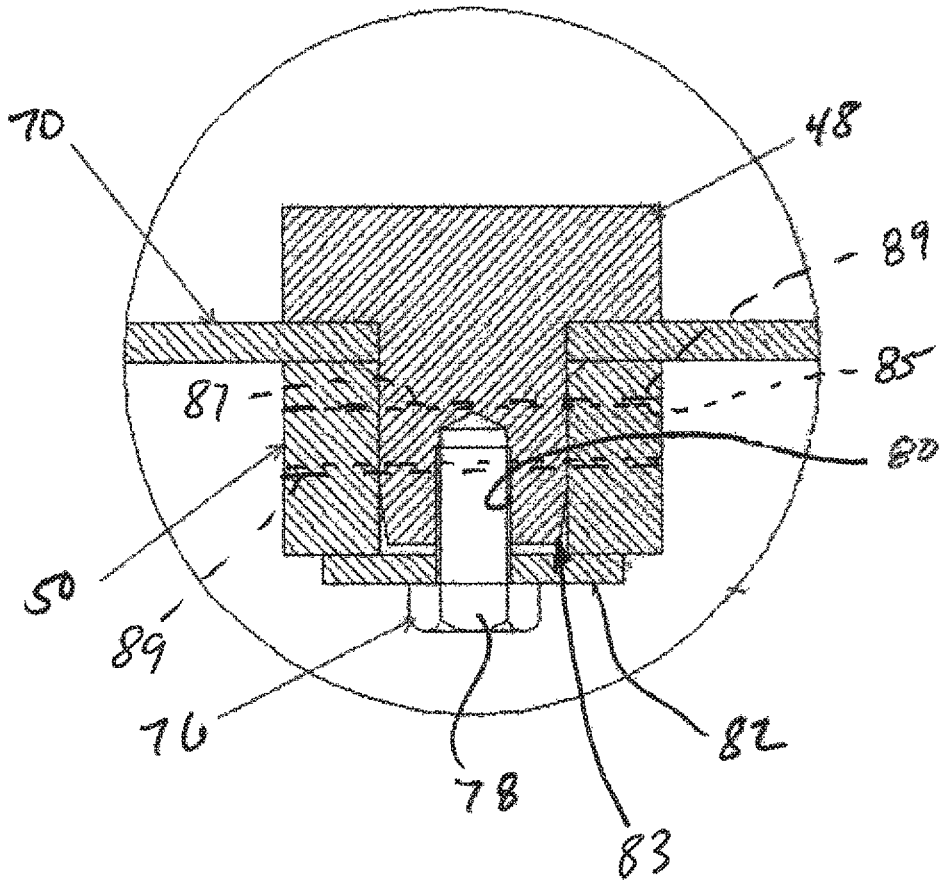
FIG. 15 illustrate a fastener for aligning and connecting stacked modules of an elevator shaft.

A plurality of aligning members can be provided on each of the modules 62*a*, 62*b* to be connected so as to ensure proper alignment of the modules 62*a*, 62*b*. Referring also to FIG. 15, in one example, the aligning members 48, 50 can comprise complementary projections 48 and recesses or receivers 50, herein apertures for the projections 48. In the illustrated embodiment, the lower module 62*a* includes the recesses or receivers 50 mounted on an upper perimeter portion 72, while the complementary projections are mounted on a lower perimeter portion 74 of module 62*b*. Preferably, the projections 48 are tapered where an end of the projection 48 that enters the receiver 50 is of lesser cross-sectional area than a base of the projection 48. The taper helps promote proper alignment of the modules. Although not to be considered limiting, typically eight or more complementary aligning members 48, 50 are used to align one module upon another.

In an advantageous embodiment, one or more of the complementary projections 48 and receivers 50 are secured with a fastener 76. In the embodiment illustrated, the fastener 76 includes a bolt 78 that is received by the projection 48 in an aperture 80 having threads. The fastener 76 includes a flange 82 that engages a lower end of the receiver 50 when the bolt 78 extends through a bore 81 in the receiver 50 and is received in aperture 80 thereby inhibiting separation of the projection 48 from the receiver 50. The flange 82 can be formed from a washer through which the bolt 78 extends. It should be noted various types of fasteners can be used to secure. For instance and without limitation, other types of fasteners include welding for instance along adjoining edge 83, bonding, pins such as inserted in aligned apertures when the aligning members engage each other schematically indicated by pin 85 and apertures 87 and 89, friction fit engaging surfaces between the complementary aligning members, e.g. surfaces with self-locking angles.

The fastened aligning members between the modules insure proper alignment where the modules are then commonly fixedly secured to the ship such as by welding typically to provide a water tight seal, for example, by welding the deck skirt. However, securing the aligning members together between at least two modules, when the modules are not in position in the ship, allows the modules to be lifted together as a unit and lowered into the ship, thereby allowing faster installation of the modules and construction of the elevator shaft.

In this embodiment, module 62*c* is the upper most module and is stacked upon module 62*b* and secured thereto with similar aligning members comprising projections 48, receivers 50 and fasteners 76 as described above. Module 62*c* also includes vertical supports 66, horizontal supports (not shown) and a deck skirt 70 similar to modules 62*a*, 62*b*. Module 62*c* does not include a side door, but rather uppermost cover doors 84.

When the modules are connected together, which will aid in aligning the elevator rails 65, the components of the modules such as the skirts 70 can then be welded to adjoining portions of the ship either once all the modules 62*a*-62*c* are joined together with the fasteners 76, or as the adjoining pairs of modules are stacked and fastened together.

Although the subject matter has been described in language specific to structural features and/or methodological acts, it is to be understood that the subject matter defined in the appended claims is not necessarily limited to the specific features or acts described above as has been held by the courts. Rather, the specific features and acts described above are disclosed as example forms of implementing the claims.

What is claimed is:

1. An elevator shaft assembly comprising:

a plurality of modules, each of the modules including:

a plurality of walls with an upper perimeter edge and a lower perimeter edge;

spaced apart elevator rails; and wherein adjacent modules are aligned with each other along mating upper and lower perimeter portions with complementary aligning members that are joined together with a fastener, the modules when joined together forming a tubular structure; and wherein the complementary aligning members comprise a projection provided on a first one of the plurality of modules and a receiver provided on a second one of the plurality of modules, the fastener comprising an element inserted into each pair of the complementary aligning members fastening the projection to the receiver, and a flange engaging a lower surface of the receiver to inhibit separation of the projection from the receiver when the fastener is received in the complementary aligning members.

2. The elevator shaft assembly of claim 1 wherein the element comprises a bolt.

3. The elevator shaft assembly of claim 2 wherein the bolt extends through a bore in the receiver and engages a threaded aperture in the projection.

4. The elevator shaft assembly of claim 1 wherein the element comprises a pin.

5. The elevator shaft assembly of claim 4 wherein the pin fastens the projection to the receiver with location of the pin in one or more apertures.

6. The elevator shaft assembly of claim 4 wherein the pin fastens projection to the receiver.

7. The elevator shaft assembly of claim 1 wherein the aligning members are secured with complementary engaging surfaces.

8. The elevator shaft assembly of claim 7 wherein the complementary aligning members include tapered surfaces that align the aligning members with respect to each other.

9. The elevator shaft assembly of claim 8 wherein the receiver is provided on the upper perimeter portion of the first one of the plurality of modules and the projection is provided on the lower perimeter portion of the second one of the plurality of modules, the second one of the plurality of modules being stacked upon the first one of the plurality of modules.

10. The elevator shaft assembly of claim 1 wherein the fastener comprises a weld formed between the complementary aligning members.

11. The elevator shaft assembly of claim 3, wherein the flange engages a lower surface of the receiver to inhibit separation of the projection from the receiver when the bolt is received in the threaded aperture.

12. A method of forming an elevator shaft assembly from a plurality of modules, each of the modules including a plurality of walls with an upper perimeter edge and a lower perimeter edge and spaced apart elevator rails, the method comprising:

stacking two of the plurality of modules upon each other, where each module includes an elevator rail, the elevator rails being aligned with each other; and joining two of the plurality of modules together along opposed upper and lower perimeter portions with a plurality of fasteners, each fastener joining complementary aligning members provided on the opposed upper and lower perimeter portions of the modules, wherein the complementary aligning members comprise a projection provided on a first one of the plurality of modules and a receiver provided on a second one of the plurality of modules, each fastener further comprising a flange engaging a lower surface of the receiver to inhibit separation of the projection from the receiver when the fastener is received in the complementary aligning members.

13. The method claim 12 and further comprising inserting the fastener between each pair of the complementary aligning members.

14. The method of claim 12 wherein the complementary aligning members comprise a projection provided on a first one of the plurality of modules and a receiver provided on a second one of the plurality of modules, the fastener fastening the projection to the receiver.

15. The method of claim 14 wherein the receiver is provided on the upper perimeter portion of the first one of the plurality of modules and the projection is providing on the lower perimeter portion of the second one of the plurality of modules, the second one of the plurality of modules being stacked upon the first one of the plurality of modules.

16. The method of claim 12 wherein the complementary aligning members include tapered surfaces that align the aligning members with respect to each other.

17. The method of claim 12 wherein the fastener comprises a weld.

* * * * *